US008604366B2

(12) United States Patent
Bower et al.

(10) Patent No.: US 8,604,366 B2
(45) Date of Patent: Dec. 10, 2013

(54) MODULAR TEST SWITCH

(75) Inventors: Andrew Bower, Amherst, NH (US); Timothy F. Masters, Boca Raton, FL (US); Roy Ball, Coral Springs, FL (US)

(73) Assignee: ABB Technology AG, Zurich (CH)

( * ) Notice: Subject to any disclaimer, the term of this patent is extended or adjusted under 35 U.S.C. 154(b) by 453 days.

(21) Appl. No.: 12/873,976

(22) Filed: Sep. 1, 2010

(65) Prior Publication Data

US 2011/0056819 A1 Mar. 10, 2011

Related U.S. Application Data

(60) Provisional application No. 61/239,807, filed on Sep. 4, 2009.

(51) Int. Cl.
*H01H 9/26* (2006.01)
*H01H 13/72* (2006.01)

(52) U.S. Cl.
USPC ..... 200/5 B; 200/307

(58) Field of Classification Search
USPC ..... 200/5 B, 307, 333
See application file for complete search history.

(56) References Cited

U.S. PATENT DOCUMENTS

| | | | |
|---|---|---|---|
| 4,249,227 | A | 2/1981 | Kato et al. |
| 5,291,553 | A | 3/1994 | Smith |
| 5,722,534 | A | 3/1998 | Wright |
| 6,384,350 | B1 | 5/2002 | Shincovich |
| 2005/0250376 | A1 | 11/2005 | Ostmeier |
| 2006/0059681 | A1 | 3/2006 | Ball |

FOREIGN PATENT DOCUMENTS

WO 2011028822 A1 3/2011

OTHER PUBLICATIONS

ABB Inc.,"FT Flexitest Family Switches, Cover and Test Plugs",pp. 1-6, DB41-079 Rev. E, Mar. 2008 ABB Inc. Coral Springs, Florida 33065 USA.

*Primary Examiner* — Renee Luebke
*Assistant Examiner* — Lheiren Mae Caroc
(74) *Attorney, Agent, or Firm* — Paul R. Katterle; Melissa J. Szczepanik

(57) ABSTRACT

A modular test switch assembly includes a plurality of stackable features that may be arranged in a variety of configurations. Each module includes a test switch and includes features to engage adjoining modules in the assembly. The entire test switch assembly is secured together using a retaining rod that is inserted through aligned thru-holes in the assembly.

8 Claims, 17 Drawing Sheets

MODULAR TEST SWITCH

CROSS-REFERENCE TO RELATED APPLICATION

This application claims the benefit of U.S. provisional patent application No. 61/239,807 filed on Sep. 4, 2009, which is hereby incorporated by reference in its entirety.

BACKGROUND OF THE INVENTION

Protective relays can be found in any environment that uses electricity, from factories to power utilities. Relaying protection applications may include motors, generators, transformers, station-buses, lines and circuits, system grounds, network systems, pilot wires, pilot channels, transmission lines, pilot relaying, backup, reclosing, synchronizing, load-shedding, frequency and many more.

Typically, relays operate in combination with current and potential transformers, which reduce the high current and potential inputs to levels usable by relays, meters and/or other instruments associate therewith. Relays are electrically connected to an electrical system through a test switch terminal. In this manner, each test switch can be associated with one or more relays. It is typically necessary to short circuit the line and load terminals during relay removal or when an adjacent test switch is opened. The test switch provides this necessary short circuit or bypass feature.

Though current test switches are reliable and robust, changing customer usage and new unpredictable uses demand greater flexibility in test switch design. Accordingly, there is a need in the art for a more flexible test switch capable of addressing expanded customer needs.

SUMMARY OF THE INVENTION

According to one aspect of the present invention, a modular test switch includes a plurality of center modules, a first end module, and a second end module. The modules are positioned in a stacked arrangement wherein the first end module and the second end module are positioned at opposing ends of the stacked arrangement. Each module includes engaging features for engaging an adjacent module in the stacked arrangement. Each module has a forward chamber, a top rear chamber, and a bottom rear chamber and carries a test switch.

The forward chamber has a top electrical connector and a bottom electrical connector positioned therein. Each of the top electrical connectors is electrically connected to a corresponding top lead in the top rear chamber and each of the bottom electrical connectors is electrically connected to a corresponding bottom lead in the bottom rear chamber.

According to another aspect of the present invention, the modular test switch has a cover assembly including a plurality of covers. The cover assembly is positionable in an open and a closed configuration. The covers are positioned in a stacked arrangement using the engaging features for engaging an adjacent cover in the stacked arrangement.

DETAILED DESCRIPTION OF THE INVENTION

Figure 1:
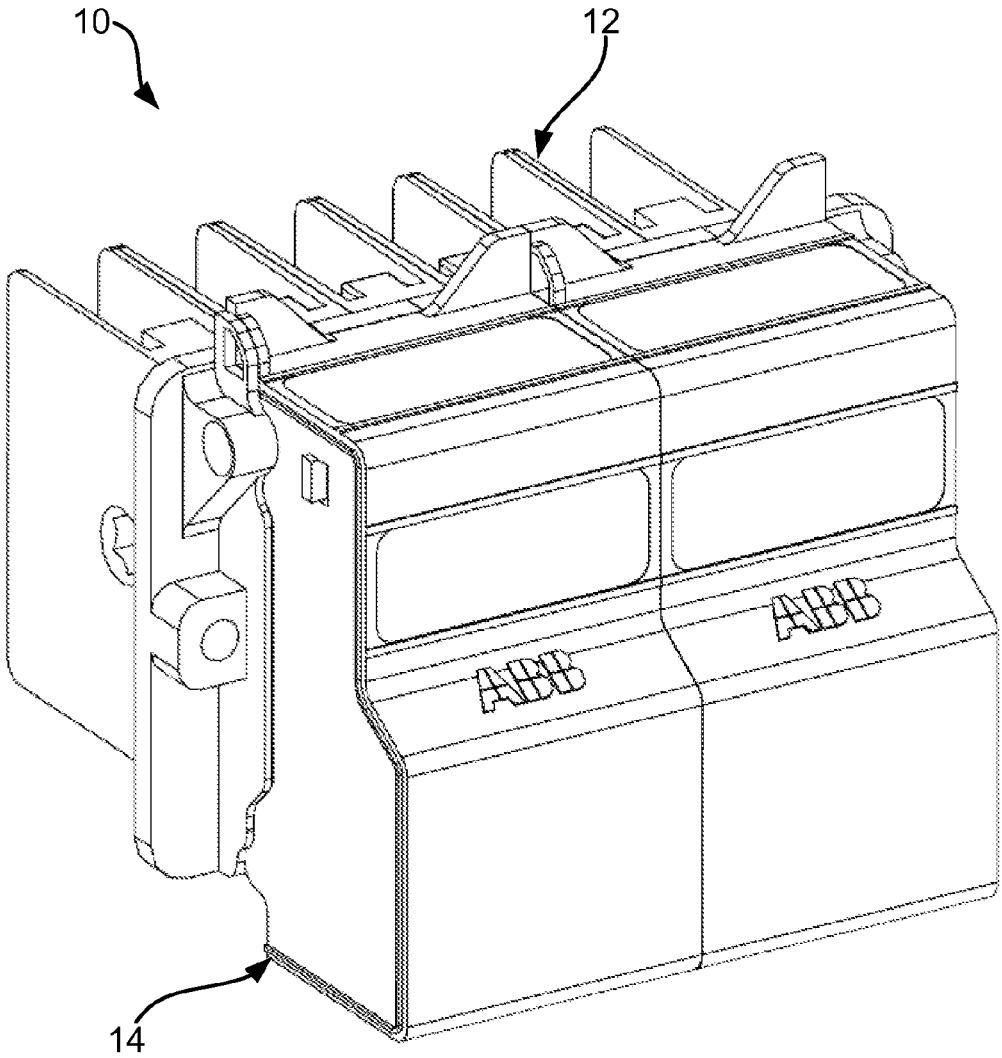
FIG. 1 is an elevated front and left side view of the test switch assembly according to the present invention with the cover assembly in the closed orientation.
Figure 2:
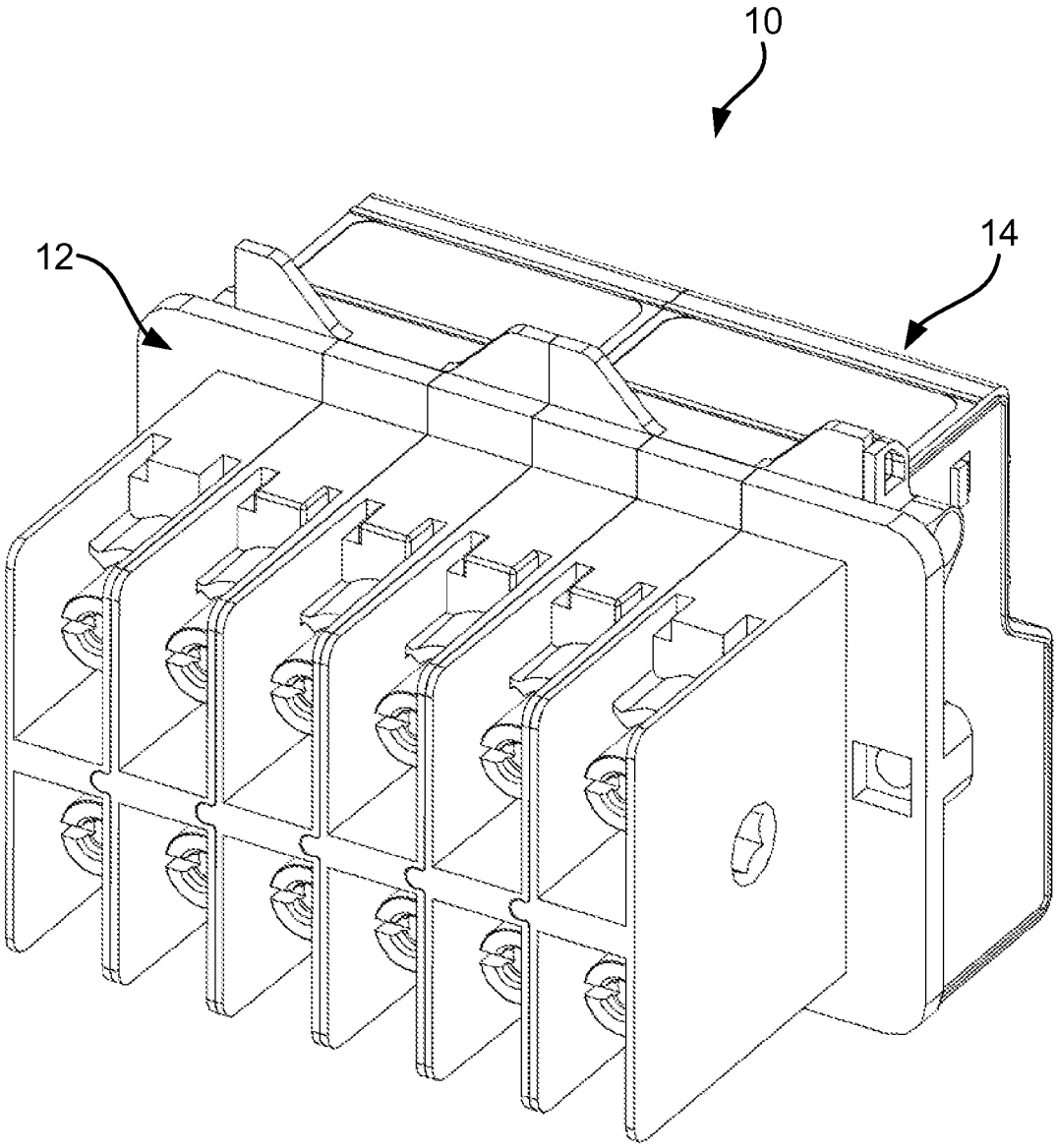
FIG. 2 is an elevated rear and left side view of the test switch assembly of FIG. 1.
Figure 3:
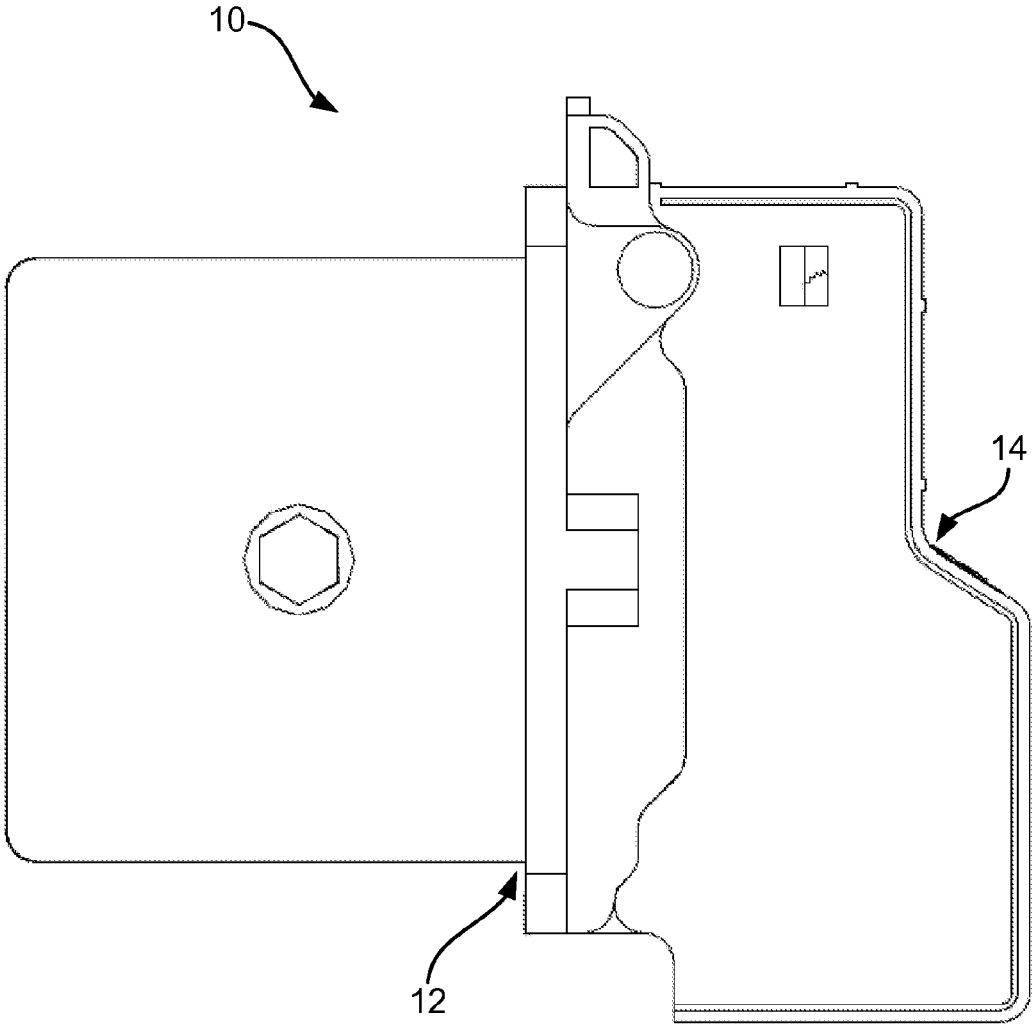
FIG. 3 is a left side view of the test switch assembly of FIG. 1.

A modular test switch terminal (hereinafter "test switch") is shown in FIGS. 1-6 and generally indicated by the numeral 10. Test switch 10 includes a switch assembly 12 and a pivoting cover assembly 14. Switch assembly 12 includes a plurality of switch modules, including center modules 18*a-d*, a left end module 20 and a right end module 22. As will become apparent, though the present invention includes six (6) modules, the test switch is easily expandable so that any number of modules may be assembled to form a switch assembly 12 in accordance with the present invention.

Figure 8:
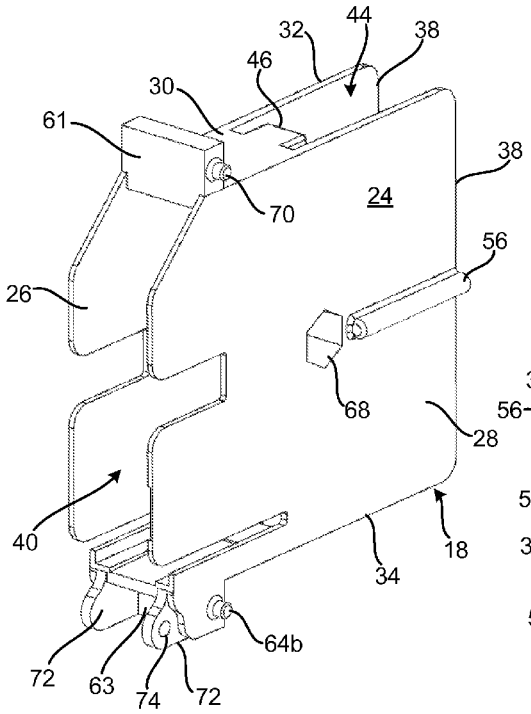
FIG. 8 is an elevated front and right side view of a center module.
Figure 9:
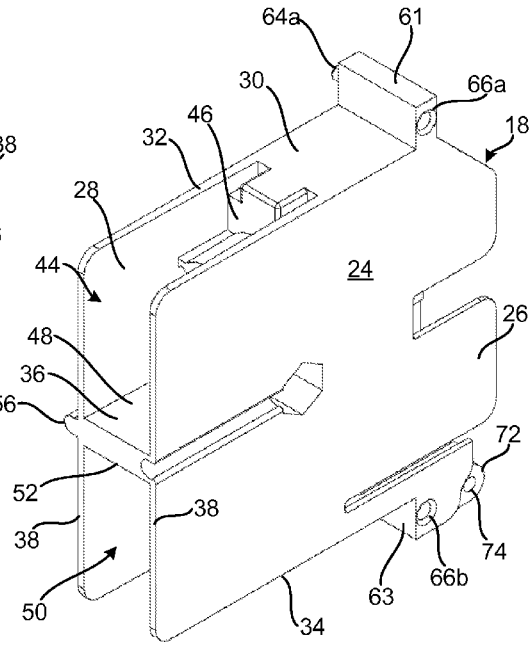
FIG. 9 is an elevated rear and left side view of a center module.
Figure 10:
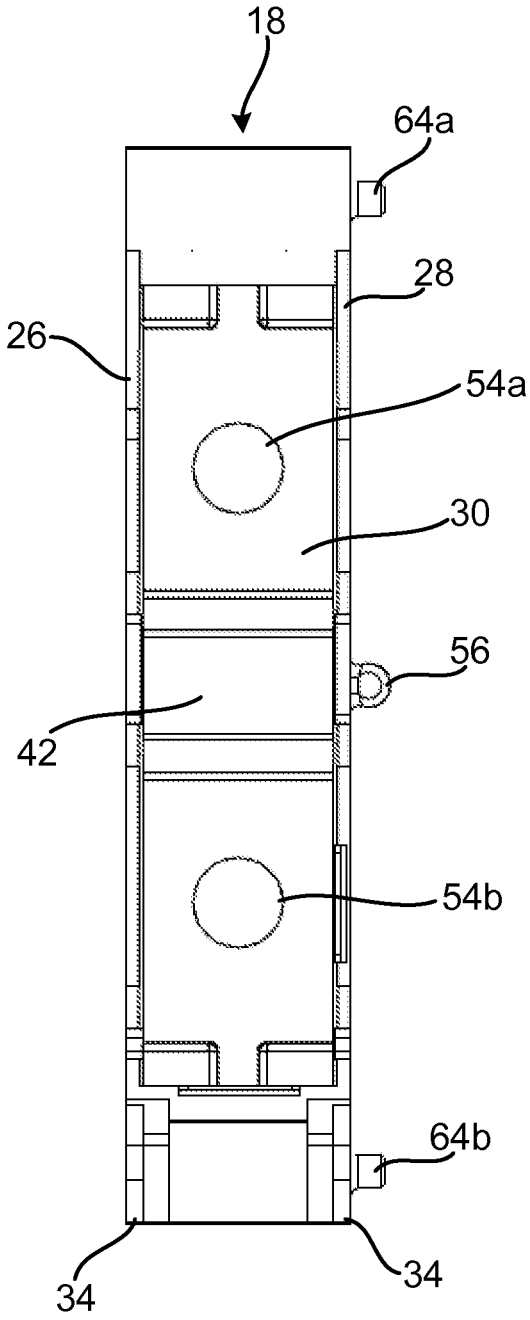
FIG. 10 is a front view of the center module.

With reference now to FIGS. 8-10, which shows the center module with the electrical components removed, each center module 18 includes a housing 24 made of non-electrically conducting material. Housing 24 includes a generally planar left side wall 26 and a generally planer right side wall 28. Walls 26 and 28 are parallel and joined by a center wall 30 that extends from a top edge 32 of walls 26/28 to a bottom edge 34 of walls 26/28. A rearwardly extending wall 36 projects rearwardly from center wall 30 to a rear edge 38 of walls 26/28. In this manner, a forward chamber 40 is defined between a front face 42 of center wall 30 and the inwardly facing surfaces of walls 26/28. Likewise, a top rear chamber 44 is defined between a rear face 46 of center wall 30, the inwardly facing surfaces of walls 26/28 and the top face 48 of rearwardly extending wall 36. A bottom rear chamber 50 is defined between rear face 46 of center wall 30, the inwardly facing surfaces of walls 26/28 and the bottom face 52 of rearwardly extending wall 36.

A hole 54*a* extends through center wall 30 from forward chamber 40 to top rear chamber 44 and a hole 54*b* extends through center wall 30 from forward chamber 40 to bottom rear chamber 50. As will described in greater detail below, holes 54*a* and 54*b* are provided to allow electrical leads to extend from the front to the rear chambers.

Center modules 18 are configured to engage adjacent modules (either center, left end or right end modules) to maintain the structural integrity of switch assembly 12. Accordingly, each housing 24 includes a longitudinal projection 56 extending outwardly from the right side wall 28 and forwardly from rear edge 38. In cross-section, projection 56 may include a semi-circular portion 58, though other cross-sectional shapes may be used. Projection 56 is adapted to engage a slot 60 that extends inwardly from left side wall 26 and forwardly from rear edge 38. In this manner, when, for example, two center modules 18 are positioned adjacent to one another, projection 56 of the first module would be received in slot 60 of the second module.

Each housing 24 further includes a top rib 61 and a bottom rib 63 that extends between left and side walls 26 and 28 proximate the front top edge and front bottom edge respectively. A pair of pins 64*a* and 64*b* extend outwardly from the right side of from top rib 61 and bottom rib 63 respectively. Pins 64 are sized and positioned to be received in matching holes 66*a* and 66*b* that extend inwardly from left side of top rib 61 and bottom rib 63 respectively. It should thus be evident that each center module 18 engages an adjacent module at three (3) points (i.e. projection 56/slot 60, pins 64*a*/hole 66*a*, and pins 64*b*/hole 66*b*).

Each housing 24 further includes a thru hole 68 that extends from left side wall 26 to right side wall 28 through center wall 30. In the present embodiment, thru-hole 68 is shaped as a hexagon in cross-section, though other cross-sectional shapes may be used. As will be described later in greater detail, thru-hole 68 receives a retaining rod 70 therethrough to secure switch assembly 12 together.

Housing 24 further includes a pair of hinge flanges 72 that are spaced, parallel and extend forwardly from the bottom front edge of housing 24. Hinge flanges 72 include a depression 74 on the outwardly facing surfaces thereof. As will be described later in greater detail, hinge flanges 72 are used to secure cover assembly 14 to switch assembly 14 in a hinged manner.

Figure 11:
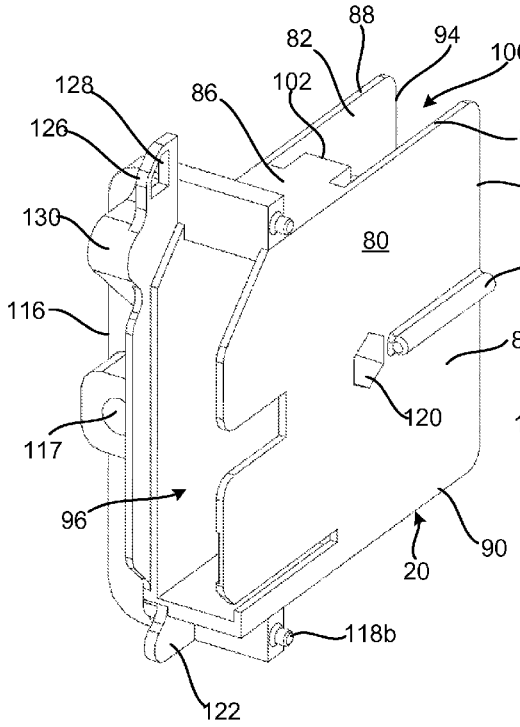
FIG. 11 is an elevated front and right side view of a left side module.
Figure 12:
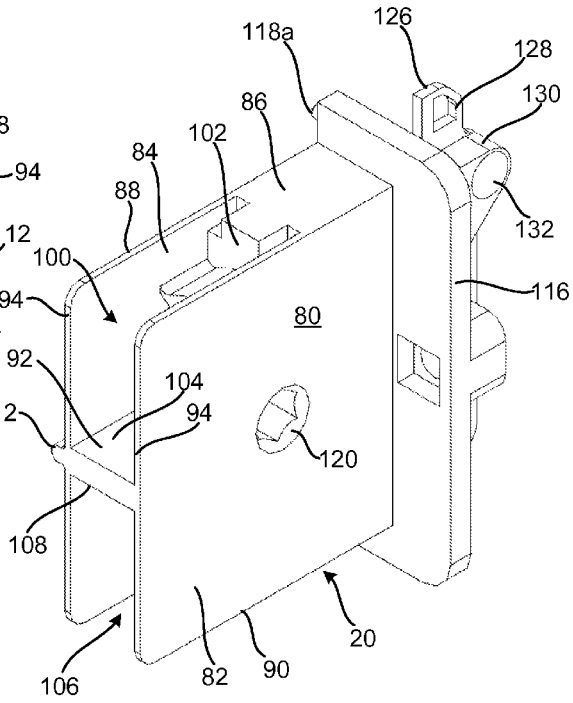
FIG. 12 is an elevated rear and left side view of a left side module.
Figure 13:
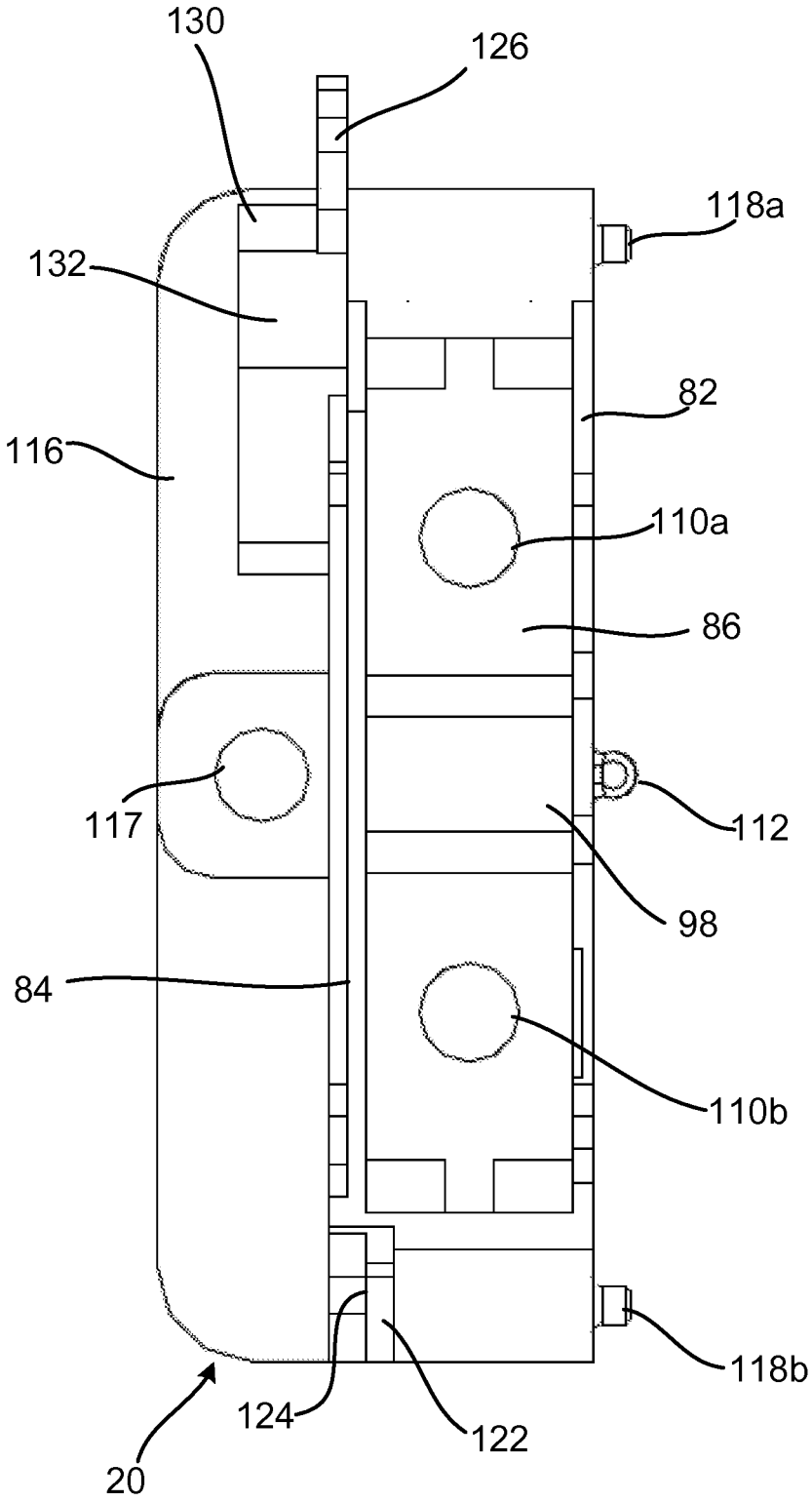
FIG. 13 is a front view of the left side module.

With reference now to FIGS. 11-13, which shows the left end module with the electrical components removed, each left end module 20 includes a housing 80 made of non-electrically conducting material. Housing 80 includes a generally planar left side wall 82 and a generally planer right side wall 84. Walls 82 and 84 are parallel and joined by a center wall 86 that extends from a top edge 88 of walls 82/84 to a bottom edge 90 of walls 82/84. A rearwardly extending wall 92 projects rearwardly from center wall 86 to a rear edge 94 of walls 82/84. In this manner, a forward chamber 96 is defined between a front face 98 of center wall 96 and the inwardly facing surfaces of walls 82/84. Likewise, a top rear chamber 100 is defined between a rear face 102 of center wall 86, the inwardly facing surfaces of walls 82/84 and the top face 104 of rearwardly extending wall 92. A bottom rear chamber 106 is defined between rear face 102 of center wall 86, the inwardly facing surfaces of walls 82/84 and the bottom face 108 of rearwardly extending wall 92.

A hole 110*a* extends through center wall 86 from forward chamber 96 to top rear chamber 100 and a hole 110*b* extends through center wall 86 from forward chamber 96 to bottom rear chamber 106. As will described in greater detail below, holes 110*a* and 110*b* are provided to allow electrical leads to extend from the front to the rear chambers.

Left end modules 20 are configured to engage center modules adjacent to the right side wall 84 to maintain the structural integrity of switch assembly 12. Accordingly, each housing 80 includes a longitudinal projection 112 extending outwardly from the right side wall 84 and forwardly from rear edge 94. In cross-section, projection 112 may include a semi-circular portion 114. Projection 112 is adapted to engage slot 60 on center module 18. In this manner, when, for example, a left end module 20 is positioned adjacent to a center module 18, projection 112 of the left end module 20 would be received in slot 60 of center module 18.

Housing 80 further includes a flange 116 that extends along left side wall 82 proximate the front edge thereof. Flange 116 wraps around and extends between right side wall 84 and left side wall 82. A hole 117 extends through flange 116 to facilitate mounting of the entire assembly to a panel (not shown) using standard mounting hardware.

A pair of pins 118*a* and 118*b* extend outwardly from the right side of flange 116 proximate to the top edge 88 and bottom edge 90 respectively. Pins 118 are sized and positioned to be received in holes 66*a* and 66*b* of center module 18. It should thus be evident that the left end module 20 engages an adjacent center module 18 at three (3) points (i.e. projection 112/slot 60, pins 118*a*/hole 66*a*, and pins 118*b*/hole 66*b*).

Housing 80 further includes a thru hole 120 that extends from left side wall 82 to right side wall 84 through center wall 86. In the present embodiment, thru-hole 120 is shaped as a hexagon in cross-section, though other cross-sectional shapes may be used. Thru-hole 120 receives retaining rod 70 therethrough to secure switch assembly 12 together.

Housing 80 further includes a hinge flange 122 that extends forwardly from the bottom front edge of housing 80. Hinge flange 122 includes a depression 124 on the outwardly facing surface (left facing) thereof. As will be described later in greater detail, hinge flange 122 is used to secure cover assembly 14 to switch assembly 14 in a pivoting manner.

Housing 80 further includes a tab 126 extending upwardly from flange 116. Tab 126 includes an opening 128 that, as will be described later in greater detail, is used to secure cover assembly 14 in the closed position. Housing 80 further includes a raised edge 130 that carries an outwardly facing magnet 132. As will be discussed in greater detail below, magnet 132 helps maintain cover assembly 14 in the closed orientation.

Figure 14:
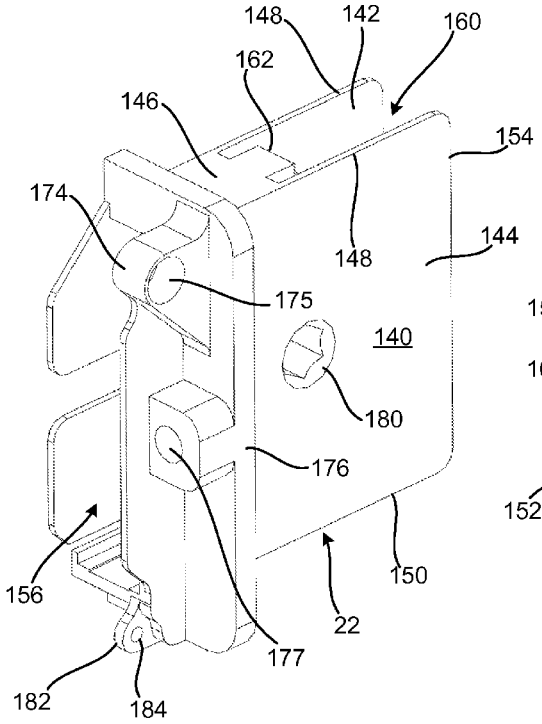
FIG. 14 is an elevated front and right side view of a right side module.
Figure 15:
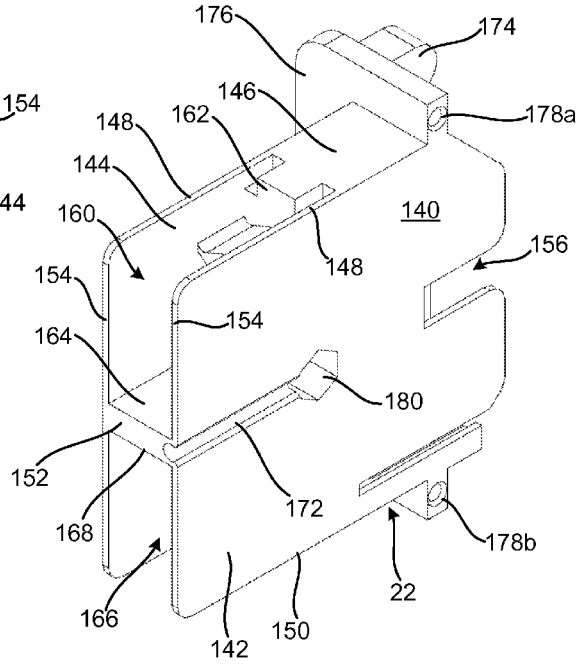
FIG. 15 is an elevated rear and left side view of a right side module.
Figure 16:
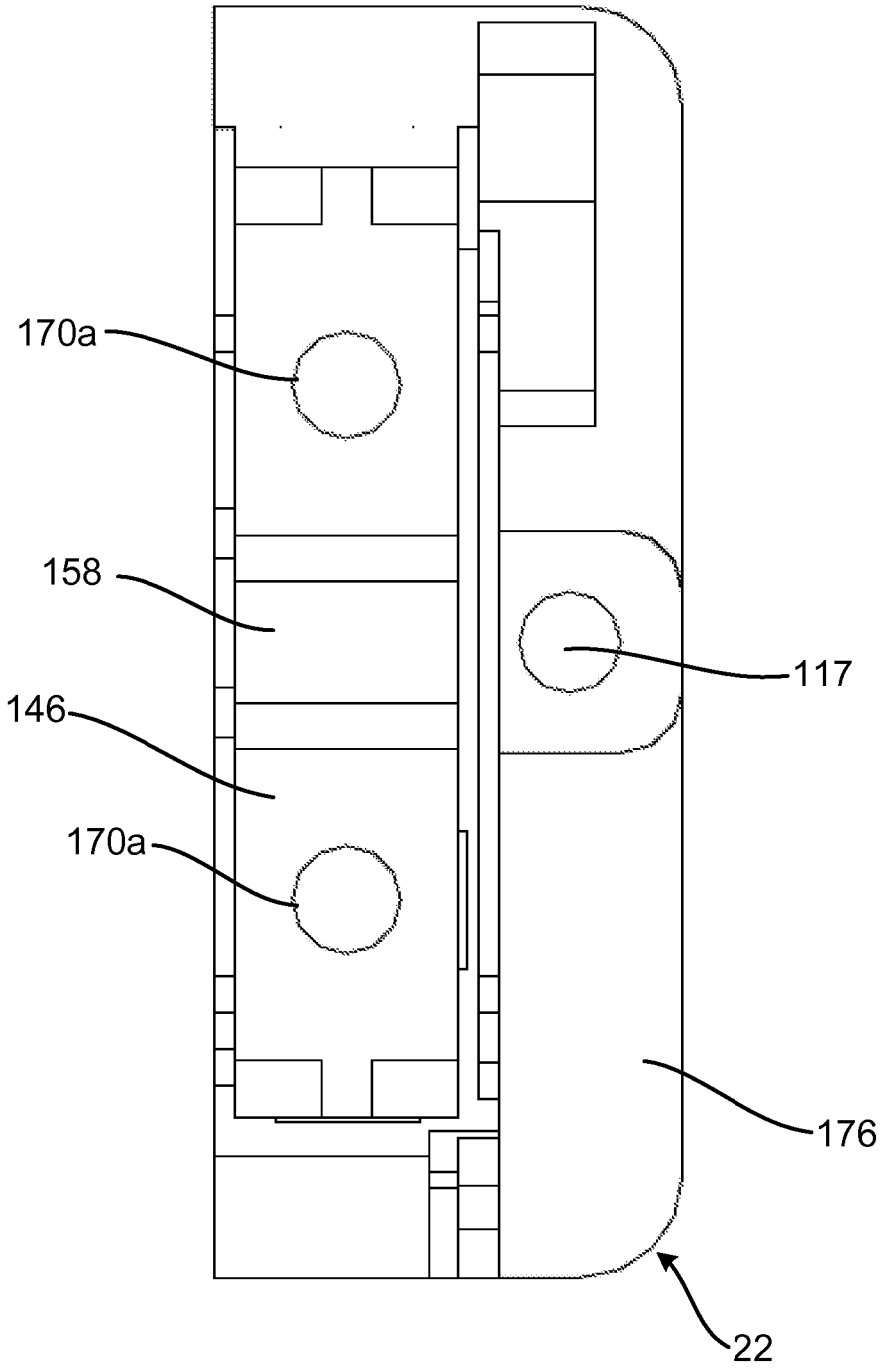
FIG. 16 is a front view of the right side module.

With reference now to FIGS. 14-16, which shows the right end module 22 with the electrical components removed, each right end module 22 includes a housing 140 made of non-electrically conducting material. Housing 140 includes a generally planar left side wall 142 and a generally planer right side wall 144. Walls 142 and 144 are parallel and joined by a center wall 146 that extends from a top edge 148 of walls 142/144 to a bottom edge 150 of walls 142/144. A rearwardly extending wall 152 projects rearwardly from center wall 146 to a rear edge 154 of walls 142/144. In this manner, a forward chamber 156 is defined between a front face 158 of center wall 146 and the inwardly facing surfaces of walls 142/144. Likewise, a top rear chamber 160 is defined between a rear face 162 of center wall 146, the inwardly facing surfaces of walls 142/144 and the top face 164 of rearwardly extending wall 152. A bottom rear chamber 166 is defined between rear face 162 of center wall 146, the inwardly facing surfaces of walls 142/144 and the bottom face 168 of rearwardly extending wall 152.

A hole 170*a* extends through center wall 146 from forward chamber 156 to top rear chamber 160 and a hole 170*b* extends through center wall 146 from forward chamber 156 to bottom rear chamber 166. As will described in greater detail below, holes 170*a* and 170*b* are provided to allow electrical leads to extend from the front to the rear chambers.

Right end modules 22 are configured to engage center modules adjacent to left side wall 142 to maintain the structural integrity of switch assembly 12. Accordingly, each housing 140 includes a slot 172 extending inwardly from the left side wall 142 and forwardly from rear edge 154. Slot 172 is adapted to engage projection 56 on center module 18. In this manner, when a right end module 22 is positioned adjacent to a center module 18, slot 172 of the right end module 22 would receive projection 56 of center module 18.

Housing 140 further includes a flange 176 that extends along right side wall 142 proximate the front edge thereof. Flange 176 wraps around and extends between right side wall 144 and left side wall 142. A hole 177 extends through flange 176 to facilitate mounting of the entire assembly to a panel (not shown) using standard mounting hardware.

A pair of holes 178*a* and 178*b* extend inwardly from the left side of flange 176 proximate to the top edge 148 and bottom edge 150 respectively. Holes 178 are sized and positioned to received pins 64*a* and 64*b* of center module 18. It should thus be evident that the right end module 22 engages an adjacent center module 18 at three (3) points (i.e. projection 56/slot 172, pin 64*a*/hole 1786*a*, and pin 64*b*/hole 178*b*).

Housing 140 further includes a thru hole 180 that extends from left side wall 142 to right side wall 144 through center wall 146. In the present embodiment, thru-hole 180 is shaped as a hexagon in cross-section, though other cross-sectional shapes may be used. Thru-hole 180 receives retaining rod 70 therethrough to secure switch assembly 12 together.

Housing 140 further includes a hinge flange 182 that extends forwardly from the bottom front edge of housing 140. Hinge flange 182 includes a depression 184 on the outwardly facing surface (right facing) thereof. As will be described later in greater detail, hinge flange 182 is used to secure cover assembly 14 to switch assembly 14 in a pivoting manner.

Housing 140 further includes a raised edge 174 carrying an outwardly facing magnet. As discussed previously, magnet 175 helps maintain cover assembly 14 in the closed orientation.

Figure 17:
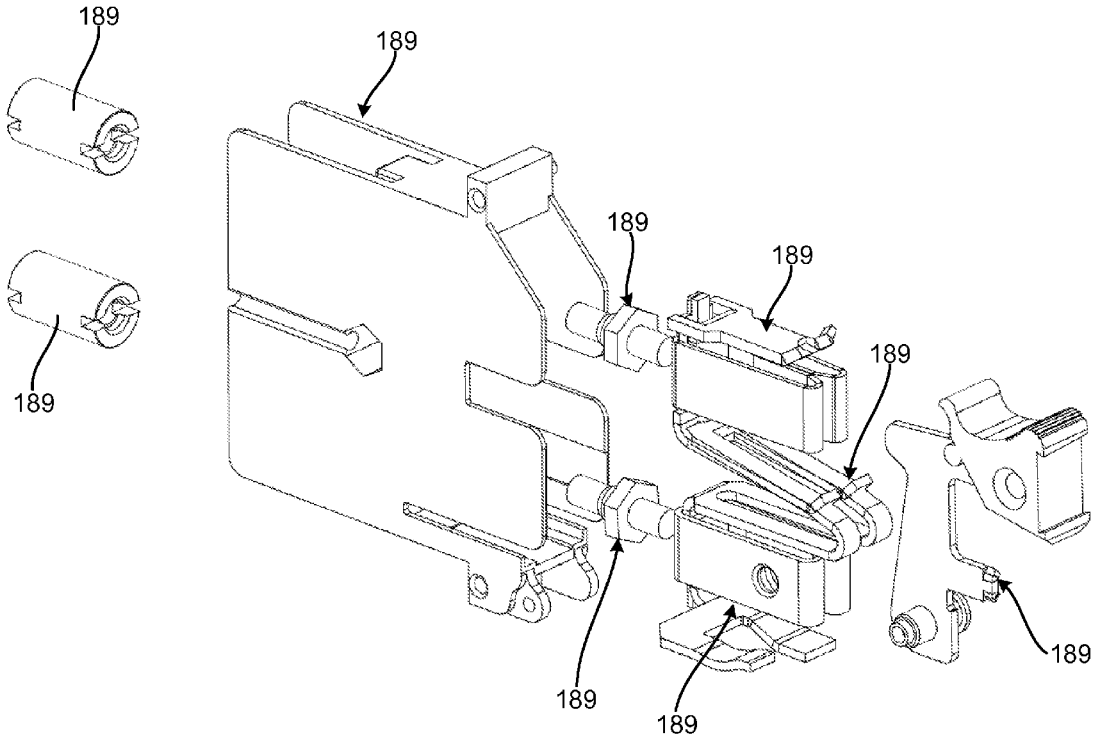
FIG. 17 is an exploded view of the center module with electrical components shown.

With reference now to FIG. 17, each housing 24, 80 and 14, carries an electrical assembly including a top electrical connector 186 and bottom electrical connector 188. Bottom electrical connector 188 carries a pivoting shorting blade 189 that may be rotated into or out of electrical connection with top electrical connector 186. The electrical assembly may also include a current test jack 16 which allows a flat blade to be inserted into the electrical path between top and bottom electrical connectors 186 and 188. A top conductor 192 connects to top electrical connector 186 and extends through top hole 54*a*/110*a*/170*a* to a threaded lead 194*a* which is positioned in top rear chamber 44/100/160 and configured for electrical connection to an external circuit. Likewise, a bottom conductor 196 connects to bottom electrical connector 188 and extends through bottom hole 54*b*/110*b*/170*b* to a threaded lead 194*b* in bottom rear chamber 50/56/166 which configured for electrical connection to an external circuit.

Figure 18:
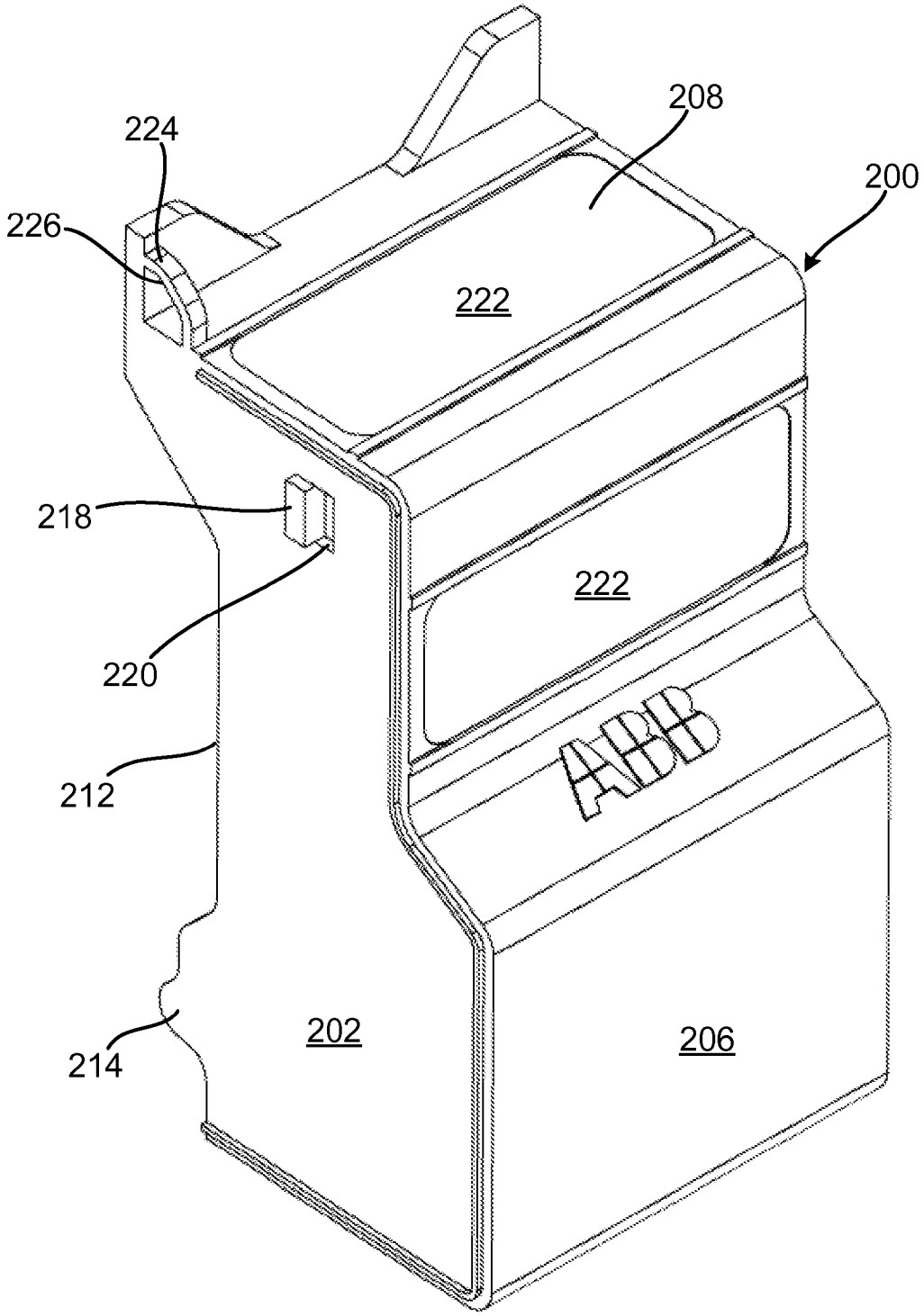
FIG. 18 is an elevated front and left side view of a cover.
Figure 19:
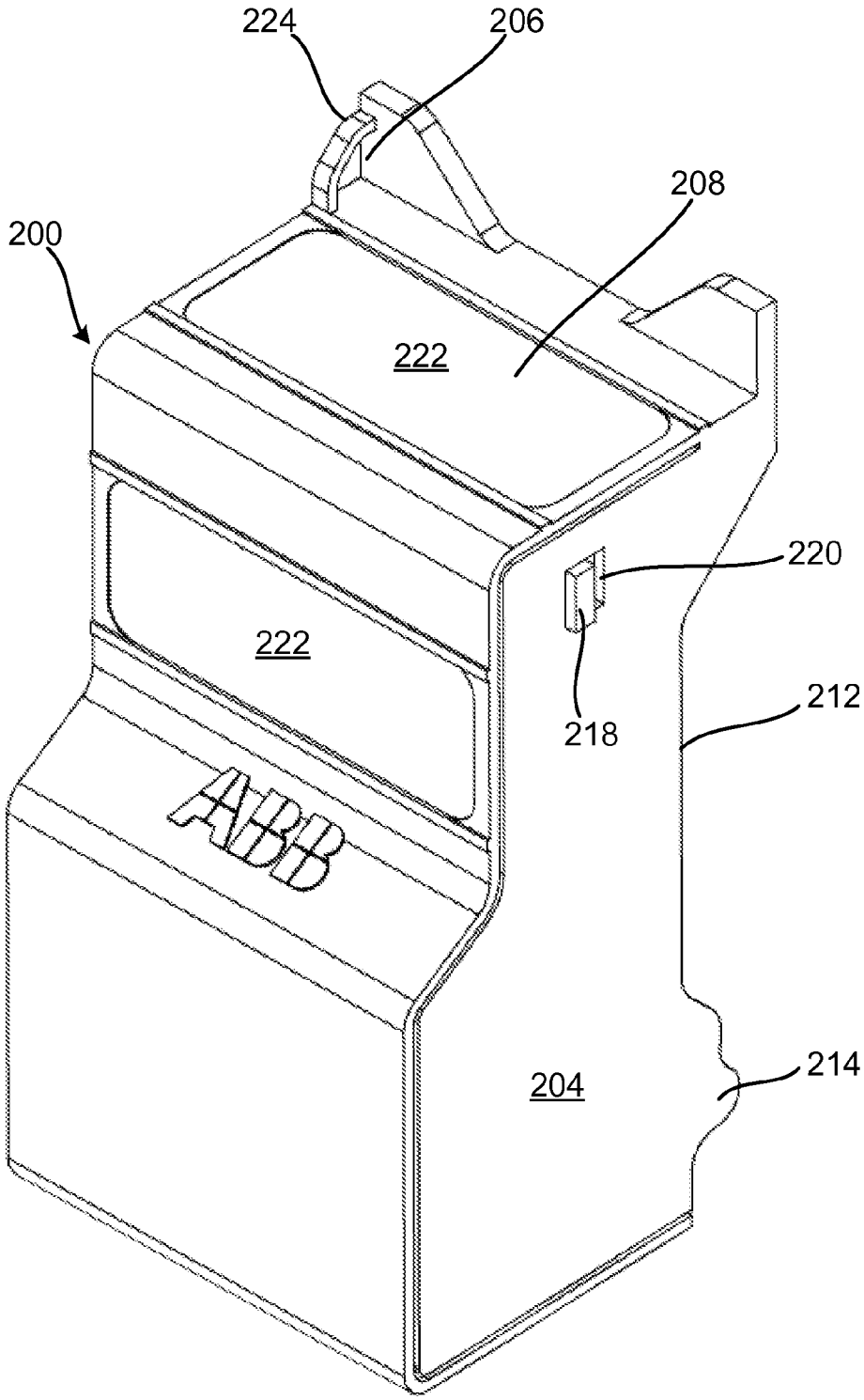
FIG. 19 is an elevated front and right side view of a cover.
Figure 20:
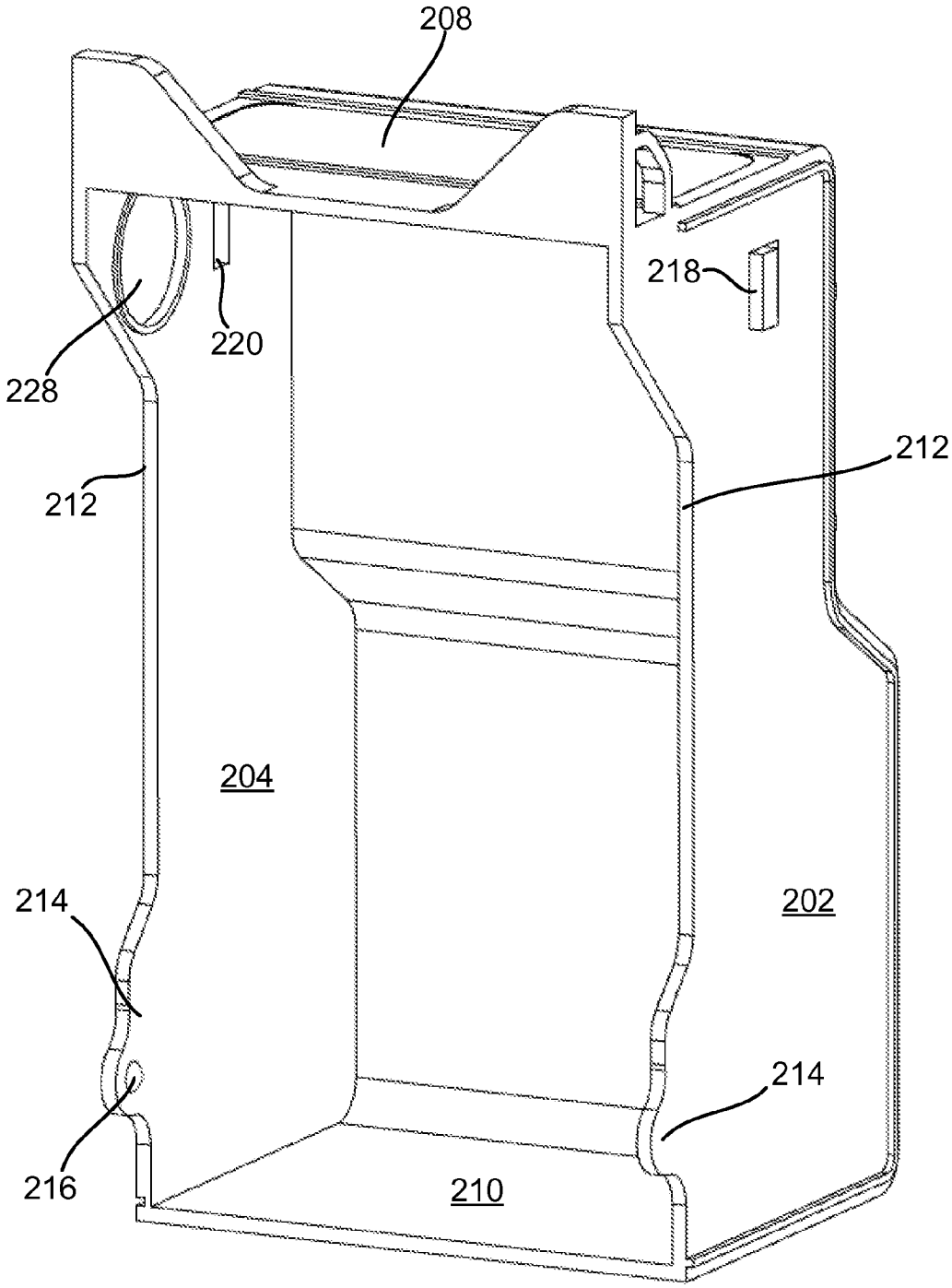
FIG. 20 is an elevated rear and left side view of a cover.

With reference now to FIGS. 18-20, cover assembly 14 includes one or more individual covers 200 each cover includes a left side wall 202, a right side wall 204, a stepped front wall 206, a top wall 208 and a bottom wall 210. Extending rearwardly from a rear edge 212 of each side wall 202 and 204 are hinge projections 214. Each hinge projection 214 includes a raised portion 216 in the inward facing surface thereof. Raised portion 216 is received in one of the depressions 74/124/184 of hinge flanges 72/122/182. In this manner, covers 200 are pivotally secured to switch assembly 12.

Figure 4:
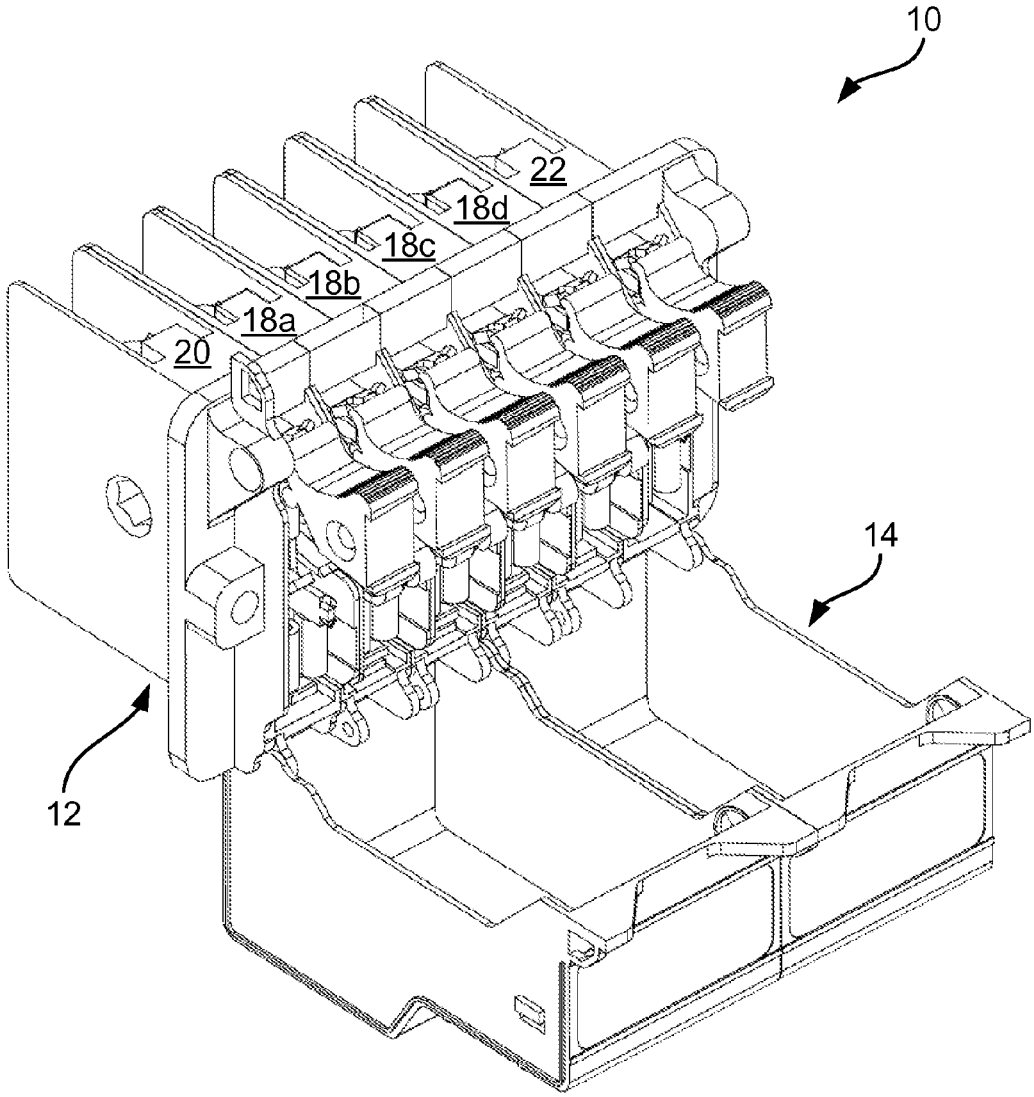
FIG. 4 is an elevated front and left side view of the test switch assembly with the cover assembly in the open orientation.
Figure 5:
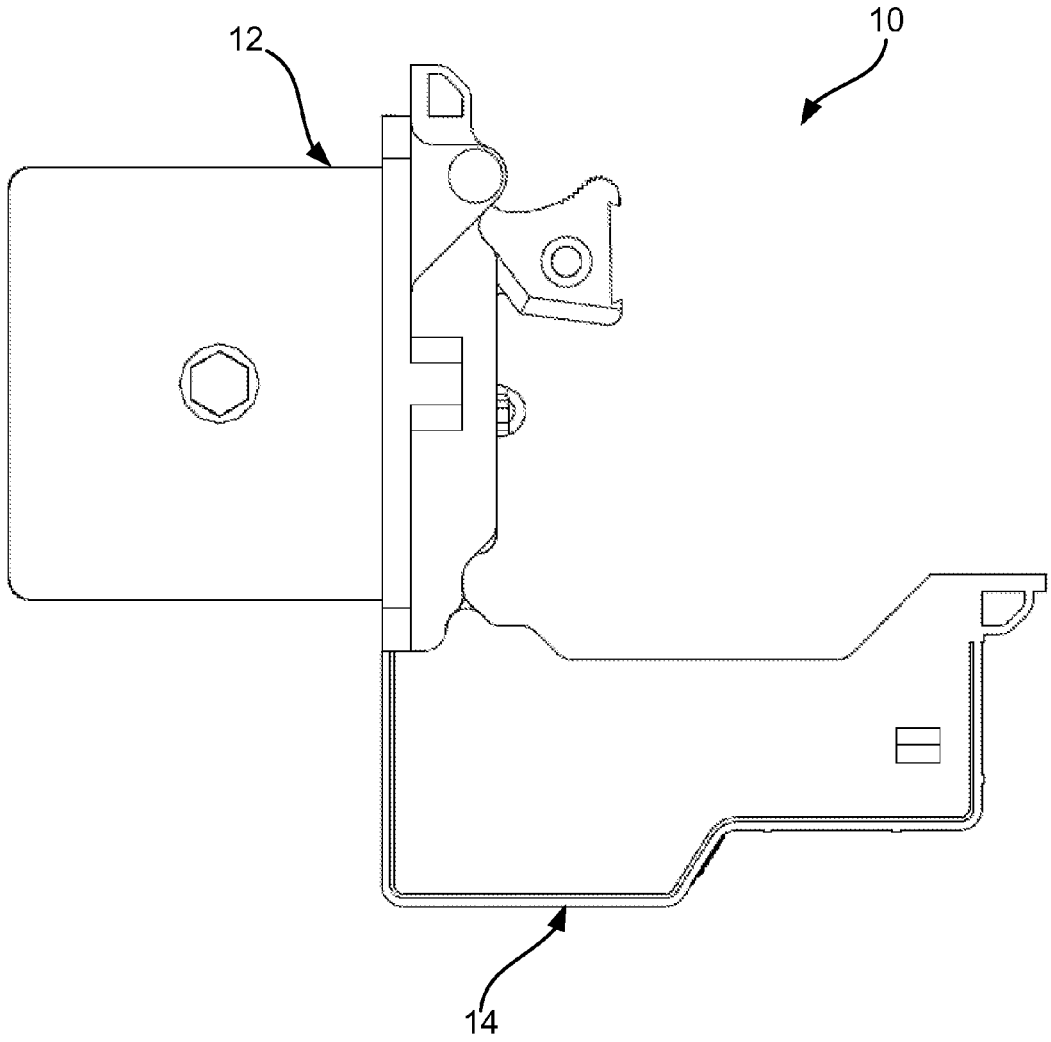
FIG. 5 is a left side view of the test switch assembly of FIG. 4.
Figure 6:
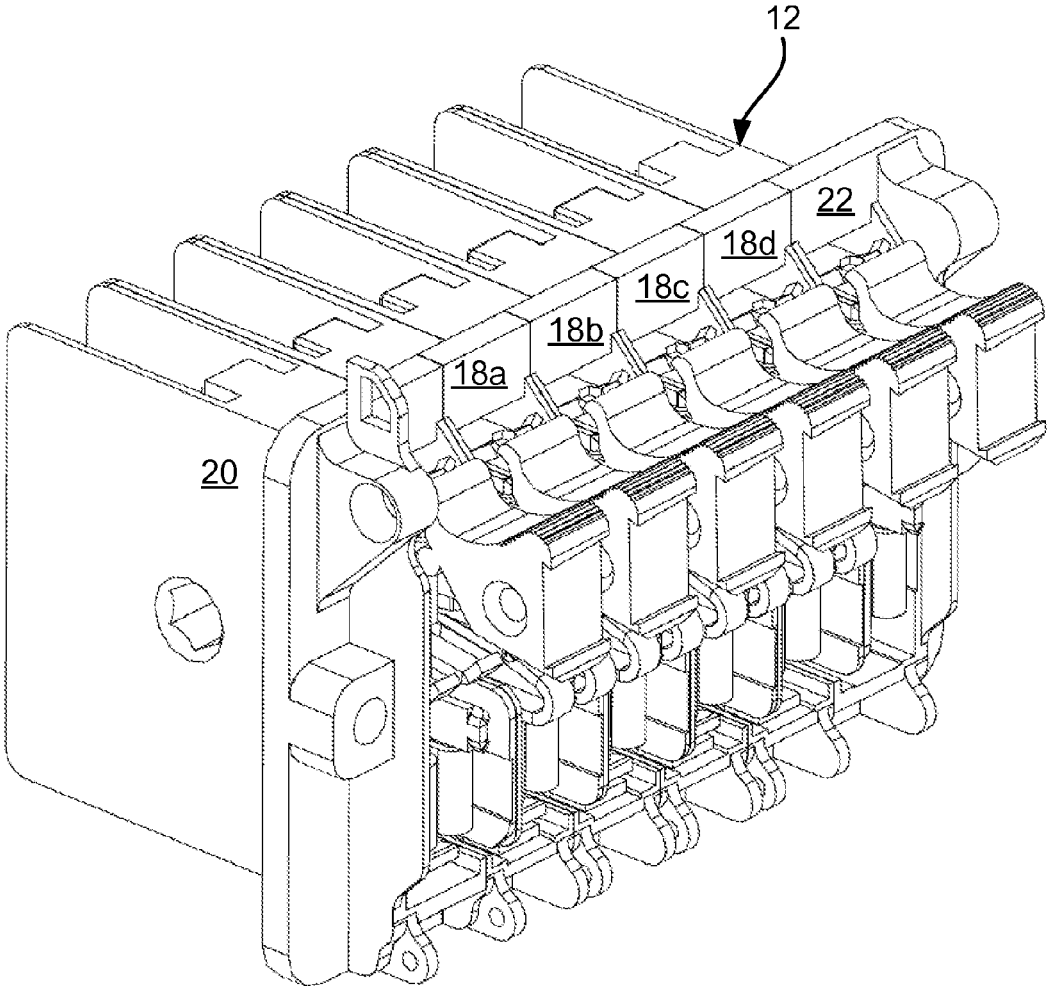
FIG. 6 is an elevated front and left side view of the switch assembly.
Figure 7:
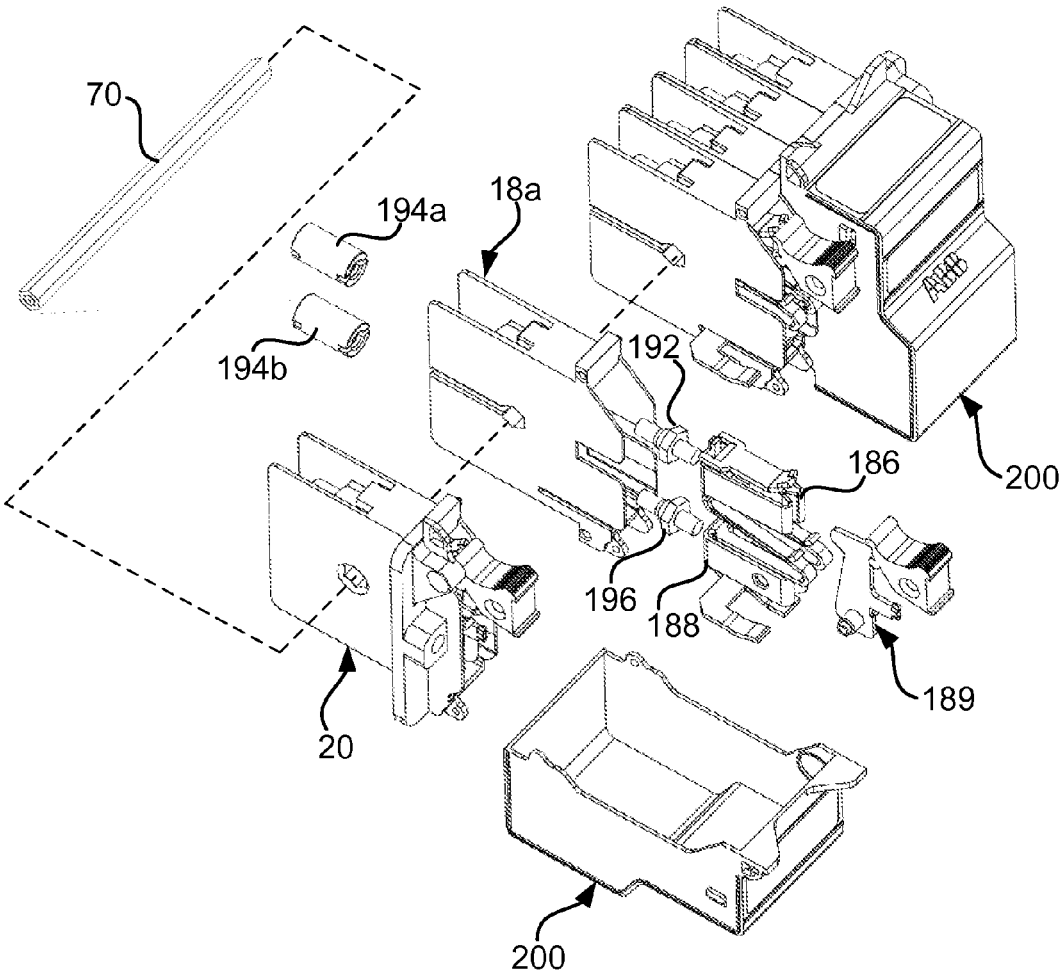
FIG. 7 is an exploded view of the test switch assembly.

On left side wall 202 a raised feature 218 is located adjacent and behind a hole 220. Right side wall 204 also includes a raised feature 218 and hole 220, however, the orientation is reversed, so that the hole 218 is behind raised feature 218. In this manner, it can be seen that when a cover 200 is placed adjacent a second cover, the raised features 218 are received in holes 220 to prevent relative movement therebetween. Thus, as seen in FIGS. 1 and 4, each cover 200 in cover assembly 14 rotates as a single unit.

Cover 200 further includes display areas 222 on the top and front walls 208 and 206. Identifying information may be printed on or secured to display areas 222. Cover 200 further includes a tab 224 extending upwardly from top wall 208. Tab 224 includes an opening 226 therethrough which, as can be seen in FIG. 1, aligns with opening 128 when cover assembly 12 is in the closed configuration. A lock or other security device may be placed through openings 128 and 224 to prevent unwanted or unintentional opening of the cover assembly 12.

On the interior surface of side walls 202 and 204, cover 200 may also include magnets 228. Magnets 228 are aligned with magnets 228 on adjacent covers 200 to hold together cover assembly 14. Magnets 228 (on the outer ends of cover assembly 14) may also be aligned with magnets 132 and 175 when in the closed orientation to hold cover assembly 14 in the closed orientation.

Thus, it should be evident that switch assembly 12 is both modular and stackable, thus enabling a user to add or subtract switch modules to suit their particular needs. For example, though the present embodiment includes six (6) switch modules (1 left side module, 1 right side module and 4 center modules), more or less center modules may be used to achieve a switch assembly 12 with any number of switches.

It should be further appreciated that the cover assembly 14 is both modular and stackable, thus enabling a user to add or subtract the appropriate number of covers 200 to adequately cover switch assembly 12. Thus, the test switch 10 is easily expandable to meet customer needs.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A modular test switch comprising: a plurality of center modules; a first end module; a second end module; each of said modules carrying a test switch and being positioned in a stacked arrangement wherein said first end module and said second end module are positioned at opposing ends of said stacked arrangement, each said module including engaging features for engaging an adjacent module in said stacked arrangement and wherein each of said modules comprises a forward chamber having a top electrical connector and a bottom electrical connector positioned therein, a top rear chamber, and a bottom rear chamber, and wherein each said top electrical connecter is electrically connected to a top lead in said top rear chamber and each said bottom electrical connector is electrically connected to a bottom lead in said bottom rear chamber.

2. The modular test switch of claim 1 wherein said engaging features of each said center module includes a plurality of holes on a first side of each said center module and a plurality of projections on a second side of each said center module being opposed from said first side.

3. The modular test switch of claim 2 wherein said engaging features of said first end module includes a plurality of holes and said engaging features of said second end module includes a plurality of projections.

4. The modular test switch of claim 1 wherein each said first end module, second end module and center modules further include a thru-hole, wherein when arranged in said stacked arrangement, said first end module thru-hole, said second end module thru-hole and each said center module thru-holes are aligned.

5. The modular test switch of claim 4 wherein a retaining rod is received in said aligned thru-holes, said retaining rod coupling together said first end module, said second end module and said plurality of center modules.

6. A modular test switch comprising: a plurality of center modules; a first end module; a second end module; each of said modules carrying a test switch and being positioned in a stacked arrangement wherein said first end module and said second end module are positioned at opposing ends of said stacked arrangement, each said module including engaging features for engaging an adjacent module in said stacked arrangement, and wherein said modular test switch further comprises a cover assembly having a plurality of covers, said cover assembly being positionable in an open and a closed configuration, said covers being positioned in a stacked arrangement wherein each said cover has engaging features for engaging an adjacent cover in said stacked arrangement.

7. The modular test switch of claim 6 wherein said engaging features of each said cover includes a hole on a first side of each said cover and a projection on a second side of each said cover being opposed from said first side.

8. The modular test switch of claim 6 wherein each said cover includes a magnet and each said end module includes a magnet, said cover magnets and said end module magnets being positioned to hold said cover assembly in said closed configuration.

* * * * *